US006784911B2

(12) United States Patent
Umeki et al.

(10) Patent No.: US 6,784,911 B2
(45) Date of Patent: Aug. 31, 2004

(54) HEAT DEVELOPING APPARATUS AND ITS CONTROL METHOD

(75) Inventors: Mamoru Umeki, Sayama (JP); Makoto Horiuchi, Hino (JP)

(73) Assignee: Konica Corporation (JP)

( * ) Notice: Subject to any disclaimer, the term of this patent is extended or adjusted under 35 U.S.C. 154(b) by 7 days.

(21) Appl. No.: 10/229,451

(22) Filed: Aug. 28, 2002

(65) Prior Publication Data

US 2003/0043257 A1 Mar. 6, 2003

(30) Foreign Application Priority Data

Sep. 6, 2001 (JP) ..... 2001-270211

(51) Int. Cl.[7] ..... B41J 2/435
(52) U.S. Cl. ..... 347/228
(58) Field of Search ..... 347/131, 133, 347/140, 228, 240, 251, 253, 254, 188, 189, 190, 192; 355/29, 401; 399/39

(56) References Cited

U.S. PATENT DOCUMENTS 5,028,963 A * 7/1991 Ohashi et al. ..... 355/401
5,873,010 A * 2/1999 Enomoto et al. ..... 399/39
6,278,477 B1 * 8/2001 Ohba ..... 347/251
6,624,876 B2 * 9/2003 Fukuda et al. ..... 355/29

* cited by examiner

*Primary Examiner*—Hai Pham
(74) *Attorney, Agent, or Firm*—Muserlian, Lucas and Mercanti

(57) ABSTRACT

A heat developing apparatus for developing a heat-processable photo-sensitive material having a supply unit provided with a loading section for loading the heat-processable photo-sensitive material, an exposure unit for forming a latent image based on an image signal or on a predetermined signal for density measurement, a developing unit for heat development, a device for gaining density information of the heat-processable photo-sensitive material developed, and a controller for conducting a correction for a density of the heat-processable photo-sensitive material based on a desired density and the density information, by controlling at least one of the exposure unit and the developing unit, wherein, the controller conducts the correction according to the density information when a predetermined condition is satisfied after a new package incorporating the heat-processable photo-sensitive material has been loaded on the loading section.

11 Claims, 7 Drawing Sheets

HEAT DEVELOPING APPARATUS AND ITS CONTROL METHOD

BACKGROUND OF THE INVENTION

The present invention relates to a heat developing apparatus and its control method for providing an image of appropriate density at all times.

According to the prior art, the heat developing apparatus used for heat development of a light sensitive film for heat development containing a latent image formed thereon is used in various manners. Some heat developing apparatuses are equipped with multiple film loading sections for use as a large-capacity tray for reducing the frequency of film supply, and others are designed to permit selection from different-sized films (14 in×17 in or 11 in×14 in) or to permit selection from films of the same size having different base densities. Further, in the heat developing apparatus, the sensitivity of the film may vary according to the lot when loaded with a new film package. Therefore, the first sheet is exposed and developed on a tentative basis according to a predetermined exposure pattern. Then the density is measured, the difference from a desired density is fed back to the process system, and the obtained density is maintained at a constant level in the step of so-called calibration. Density correction is performed for the subsequent heat development, thereby providing an image of appropriate density in some cases, according to the prior art. However, especially the heat-processable photo-sensitive material has relatively large variations of sensitivities according to the lot. So special emphasis is placed on this calibration step.

The distribution of temperature in the apparatus may undergo temporary change when the cover or the like is released to load the film on the main unit side of the heat developing apparatus, or power supply to the major portion of the equipment may be shut off for the purpose of ensuring electric safety when the door is opened. In the exposure system using acousto-optic modulation (AOM) means in this case, the characteristics of the AOM driver circuit as well as the temperature in the exposure section may undergo changes. Further, if the light sensitive film for heat development is left in the apparatus for a long time, the sensitivity is known to change and the sensitivity is found to deteriorate. If the temperature inside the apparatus is high, sensitivity tends to deteriorate easily in some cases. As a result, in some of the prior art heat developing apparatuses, calibration is automatically performed immediately when the door is closed after the tray has run out of film and the door has been opened to load a new film package.

However, when the film immediately after having been loaded does not sufficiently conform to the temperature in the apparatus, and the exposure system and the AOM system in particular is easily subjected to the temperature characteristics of the driver. If calibration is performed under these conditions, correction has not been conducted adequately in some cases. Further, for example, when the upper and lower trays are used as the aforementioned large-capacity tray after calibration, the film of the upper tray is used automatically if the lower tray runs out of film. During the time, a new film is loaded into the lower tray and calibration is performed. Actually, there is time before the film on the lower tray is used, and calibration data becomes invalid in some cases under the influence of the temperature history in the apparatus during this time, according to the prior art.

In view of the aforementioned problems involved in the prior art, it is an object of the present invention to provide a heat developing apparatus and its control method that eliminates the adverse effect of the variations in temperature inside the apparatus upon the development density and ensures an image of appropriate density at all times.

SUMMARY OF THE INVENTION

To achieve the aforementioned object, the first heat developing apparatus of the present invention comprises:

- supply means (unit) having multiple loading sections for loading a heat-processable photo-sensitive material,
- exposure means (unit) for forming a latent image on the aforementioned heat-processable photo-sensitive material fed by the aforementioned supply means in response to an image signal or a predetermined signal for measuring density,
- development means (developing unit) for heat development of a heat-processable photo-sensitive material containing the aforementioned latent image,
- means (a device) for gaining information on the density of the aforementioned developed heat-processable photo-sensitive material, and
- control means (controller) for controlling either or both of the aforementioned exposure means and the aforementioned developing means in such a way that the difference from a desired density is corrected based on the aforementioned density information;
- wherein correction is performed by the aforementioned control means based on the aforementioned density information obtained by forming and developing a latent image in response to the predetermined signal for measuring the aforementioned density, when the aforementioned image signal is received and a print request is received after a new package incorporating the aforementioned heat-processable photo-sensitive material has been loaded on the aforementioned loading section.

This first heat developing apparatus provides correction by control means when the apparatus has received a print request, not immediately after a new package including the heat-processable photo-sensitive material has been loaded. So the heat-processable photo-sensitive material can be exposed and developed after it has been corrected for density at the temperature inside the apparatus immediately before exposure and development of the heat-processable photo-sensitive material. This properly eliminates impact upon development density of the variation of sensitivity of the heat-processable photo-sensitive material due to changes of temperature in the apparatus and characteristic changes of exposure means, thereby ensuring an image of appropriate density at all times.

The second heat developing apparatus of the present invention comprises:

- supply means having multiple loading sections for loading a heat-processable photo-sensitive material,
- exposure means for forming a latent image on the aforementioned heat-processable photo-sensitive material fed by the aforementioned supply means in response to an image signal or a predetermined signal for measuring density,
- development means for heat development of a heat-processable photo-sensitive material containing the aforementioned latent image,
- means for gaining information on the density of the aforementioned developed heat-processable photo-sensitive material, and control means for controlling either or both of the aforementioned exposure means and the aforementioned developing means in such a way that the difference from a desired density is corrected based on the aforementioned density information;

wherein correction is performed by the aforementioned control means based on the aforementioned density information obtained by forming and developing a latent image in response to the predetermined signal for measuring the aforementioned density if the aforementioned image signals have already been received when a new package incorporating the aforementioned heat-processable photo-sensitive material is loaded on the aforementioned loading section.

This second heat developing apparatus provides correction by control means when multiple signals are input to the apparatus and the system is waiting for printing, not immediately after a new package including the heat-processable photo-sensitive material has been loaded. So the heat-processable photo-sensitive material can be exposed and developed after it has been corrected for density at the temperature inside the apparatus immediately before exposure and development of the heat-processable photo-sensitive material. This properly eliminates impact upon development density of the variation of sensitivity of the heat-processable photo-sensitive material due to changes of temperature in the apparatus and characteristic changes of exposure means, thereby ensuring an image of appropriate density at all times.

The third heat developing apparatus of the present invention comprises:

supply means having multiple loading sections for loading a heat-processable photo-sensitive material, exposure means for forming a latent image on the aforementioned heat-processable photo-sensitive material fed by the aforementioned supply means in response to an image signal or a predetermined signal for measuring density, development means for heat development of a heat-processable photo-sensitive material containing the aforementioned latent image, means for gaining information on the density of the aforementioned developed heat-processable photo-sensitive material, and control means for controlling either or both of the aforementioned exposure means and the aforementioned developing means in such a way that the difference from a desired density is corrected based on the aforementioned density information;

wherein correction is performed by the aforementioned control means based on the aforementioned density information obtained by forming and developing a latent image in response to the predetermined signal for measuring the aforementioned density, a predetermined time after a new package incorporating the aforementioned heat-processable photo-sensitive material has been loaded on the aforementioned loading section.

This third heat developing apparatus provides correction by control means after the lapse of a predetermined time, not immediately after a new package including the heat-processable photo-sensitive material has been loaded. This permits the heat-processable photo-sensitive material to be exposed and developed after the heat-processable photo-sensitive material in the package has been corrected for density when it has sufficiently conformed to the temperature inside the apparatus and the exposure means and developing means have reached the steady state characterized by few characteristic changes. This properly eliminates impact upon development density of the variation of sensitivity of the heat-processable photo-sensitive material due to changes of temperature in the apparatus and characteristic changes of exposure means, thereby ensuring an image of appropriate density at all times. In this case, it is possible, for example, to make arrangements in such a way that the control means is equipped with a timer where a predetermined time is set, and the timer operates upon loading of a new package.

The fourth heat developing apparatus of the present invention comprises:

supply means having multiple loading sections for loading a heat-processable photo-sensitive material, exposure means for forming a latent image on the aforementioned heat-processable photo-sensitive material fed by the aforementioned supply means in response to an image signal or a predetermined signal for measuring density, development means for heat development of a heat-processable photo-sensitive material containing the aforementioned latent image, means for gaining information on the density of the aforementioned developed heat-processable photo-sensitive material, and control means for controlling either or both of the aforementioned exposure means and the aforementioned developing means in such a way that the difference from a desired density is corrected based on the aforementioned density information;

wherein correction is performed by the aforementioned control means based on the aforementioned density information obtained by forming and developing a latent image in response to the predetermined signal for measuring the aforementioned density, a predetermined time after the aforementioned heat developing apparatus has become ready state, after a new package incorporating the aforementioned heat-processable photo-sensitive material has been loaded on the aforementioned loading section.

This fourth heat developing apparatus provides correction by control means a predetermined time after the apparatus gets ready for printing, not immediately after a new package including the heat-processable photo-sensitive material has been loaded. This permits the heat-processable photo-sensitive material to be exposed and developed after the heat-processable photo-sensitive material in the package has been corrected for density when it has sufficiently conformed to the temperature inside the apparatus and the exposure means and developing means have reached the steady state characterized by few characteristic changes. This properly eliminates impact upon development density of the variation of sensitivity of the heat-processable photo-sensitive material due to changes of temperature in the apparatus and characteristic changes of exposure means, thereby ensuring an image of appropriate density at all times. In this case, it is possible, for example, to make arrangements in such a way that the control means is equipped with a timer where a predetermined time is set, and the timer operates when the apparatus becomes ready.

In the third or fourth heat developing apparatus, the aforementioned exposure means comprises either or both of the acousto-optic modulation driver and high frequency superposing section, and the aforementioned predetermined time can be set based on either or both of the temperature characteristics of the aforementioned acousto-optic modulation driver and the temperature characteristics of the aforementioned high frequency superposing section. This allows the correction to be performed by the control means after the lapse of a predetermined time when the temperature characteristics of the aforementioned acousto-optic modulation driver and the temperature characteristics of the aforementioned high frequency superposing section have reached the steady state. Thus, validity of the correction for the density thereof is maintained on a stable basis, and an image of appropriate density can be supplied at all times.

The fifth heat developing apparatus of the present invention comprises:

supply means having multiple loading sections for loading a heat-processable photo-sensitive material, exposure means for forming a latent image on the aforementioned heat-processable photo-sensitive material fed by the aforementioned supply means in response to an image signal or a predetermined signal for measuring density, development means for heat development of a heat-processable photo-sensitive material containing the aforementioned latent image, means for gaining information on the density of the aforementioned developed heat-processable photo-sensitive material, and control means for controlling either or both of the aforementioned exposure means and the aforementioned developing means in such a way that the difference from a desired density is corrected based on the aforementioned density information;

wherein correction is performed by the aforementioned control means based on the aforementioned density information obtained by forming and developing a latent image in response to the predetermined signal for measuring the aforementioned density, when the aforementioned developing means has reached a predetermined temperature history after a new package incorporating the aforementioned heat-processable photo-sensitive material has been loaded on the aforementioned loading section.

This fifth heat developing apparatus provides correction by control means when the developing means as a major heat source in the apparatus has reached a predetermined temperature history, not immediately after a new package including the heat-processable photo-sensitive material has been loaded. This permits the heat-processable photo-sensitive material to be exposed and developed after it has been corrected for density when the temperature in the apparatus has reached the steady state. This properly eliminates impact upon development density of the variation of sensitivity of the heat-processable photo-sensitive material due to changes of temperature in the apparatus and characteristic changes of exposure means, thereby ensuring an image of appropriate density at all times.

In the fifth heat developing apparatus, a temporary change in the distribution of temperature in the apparatus is caused by opening of the door of the heat developing apparatus, for example, when a new package is loaded. Further, electric supply to the major portion of the apparatus is cut off for the sake of ensuring electrical safety at the time of opening the door, resulting in a temporary reduction of the temperature of the developing means. The developing means goes back to the predetermined temperature after the door has been closed, and correction is started by the control means after the lapse of a predetermined time. This arrangement properly eliminates the influence of the characteristic changes of the developing means resulting from reduced temperature, thereby ensuring density correction to be performed.

Further, the aforementioned heat developing apparatus comprises multiple aforementioned loading sections. As a result, when a new package is loaded into one of the loading sections during the use of the apparatus, density correction can be performed at properly timed intervals under the conditions of the aforementioned first to fifth heat development apparatuses, while the heat development material is supplied from another loading section, without the heat development material of this new package being corrected by the control means immediately.

The sixth heat developing apparatus of the present invention comprises:

supply means having multiple loading sections for loading a heat-processable photo-sensitive material, exposure means for forming a latent image on the aforementioned heat-processable photo-sensitive material fed by the aforementioned supply means in response to an image signal or a predetermined signal for measuring density, development means for heat development of a heat-processable photo-sensitive material containing the aforementioned latent image, means for gaining information on the density of the aforementioned developed heat-processable photo-sensitive material, and control means for controlling either or both of the aforementioned exposure means and the aforementioned developing means in such a way that the difference from a desired density is corrected based on the aforementioned density information;

wherein the next correction is performed a predetermined time after a correction is performed by the aforementioned control means based on the aforementioned density information obtained by forming and developing a latent image in response to the predetermined signal for measuring the aforementioned density.

In the sixth heat developing apparatus, correction is again performed by the control means after the lapse of a predetermined time. This arrangement allows density correction to be performed at properly timed intervals, in response to changes in sensitivity of the heat-processable photo-sensitive material and characteristic change of the exposure means due to the influence of the changes in the temperature inside the apparatus resulting from the passage of a predetermined time, thereby supplying an image of appropriate density at all times.

The seventh heat developing apparatus of the present invention comprises:

supply means having multiple loading sections for loading a heat-processable photo-sensitive material, exposure means for forming a latent image on the aforementioned heat-processable photo-sensitive material fed by the aforementioned supply means in response to an image signal or a predetermined signal for measuring density, development means for heat development of a heat-processable photo-sensitive material containing the aforementioned latent image, means for gaining information on the density of the aforementioned developed heat-processable photo-sensitive material, and control means for controlling either or both of the aforementioned exposure means and the aforementioned developing means in such a way that the difference from a desired density is corrected based on the aforementioned density information;

wherein, after correction is performed by the aforementioned control means based on the aforementioned density information obtained by forming and developing a latent image in response to the predetermined signal for measuring the aforementioned density, the density value of the aforementioned heat-processable photo-sensitive material is read by the means for obtaining the aforementioned density information, and the density value read is compared with the reference (standard) density value, and the aforementioned next correction is performed if a predetermined variation in density has occurred.

In the seventh heat developing apparatus, correction is performed again by the control means if a predetermined level is exceeded by the variation of density obtained by comparison between the density value obtained from the heat-processable photo-sensitive material where the normal image is developed during the use of the apparatus and the reference density. Despite changes in the sensitivity of the heat-processable photo-sensitive material and characteristic changes of the exposure means under the influence of temperature changes in the apparatus as well as changes in the development density, this arrangement ensures density correction to be performed at properly timed intervals, thereby providing an image of appropriate density at all times. In this case, the reference value can be a predetermined density or the density measured in the previous correction by the control means.

Further, the eighth heat developing apparatus of the present invention comprises:

supply means having multiple loading sections for loading a heat-processable photo-sensitive material, exposure means for forming a latent image on the aforementioned heat-processable photo-sensitive material fed by the aforementioned supply means in response to an image signal or a predetermined signal for measuring density, development means for heat development of a heat-processable photo-sensitive material containing the aforementioned latent image, means for gaining information on the density of the aforementioned developed heat-processable photo-sensitive material, and control means for controlling either or both of the aforementioned exposure means and the aforementioned developing means in such a way that the difference from a desired density is corrected based on the aforementioned density information;

wherein correction is performed by the aforementioned control means based on the aforementioned density information obtained by forming and developing a latent image in response to the predetermined signal for measuring the aforementioned density, a predetermined time after the development by the aforementioned developing means.

In the eighth heat developing apparatus, correction is again performed, a predetermined time after the previous development by developing means. In response to changes in the sensitivity of the heat-processable photo-sensitive material and characteristic changes of the exposure means due to the passage of the predetermined time, this arrangement ensures density correction to be performed at properly timed intervals, thereby providing an image of appropriate density at all times.

According to the eighth heat developing apparatus, when the power supplied of the heat developing apparatus is turned off for a long time, for example, on non-business day or the like, the time from the previous development is measured by a timer or the like, and power supply is turned on again to permit control to be performed by the control means after the lapse of a predetermined time. This arrangement allows density correction to be performed at properly timed intervals even if the apparatus is not used for a comparatively long time.

The aforementioned sixth to eighth heat development apparatuses allow correction to be performed by the control means when a new package incorporating the heat-processable photo-sensitive material has been loaded. Then it allows correction to be made again by the control means under the aforementioned conditions. The number of the loading section of the sixth to eighth heat developing apparatuses may be one or more than one.

Correction by the control means in the aforementioned first to eighth heat developing apparatuses can be performed by changing either or both of the amount of light of the aforementioned exposure means and temperature in development by the aforementioned developing means. This arrangement allows the development density of heat-processable photo-sensitive material to be changed to a desired density.

In the aforementioned first to eighth heat developing apparatuses, the aforementioned loading section is loaded with a package incorporating the aforementioned heat-processable photo-sensitive material and indicating the characteristic information on the heat-processable photo-sensitive material. So the aforementioned characteristic information is read, and either or both of the amount of light of the aforementioned exposure means and development temperature of the aforementioned development means is preferably set based on the characteristic information read in this manner. This arrangement allows the amount of light of the exposure means and development temperature to be set, based on the characteristic information, even if the characteristics of the heat-processable photo-sensitive material are different for each lot, so variations of density due to variations of characteristics for each lot can be corrected. This arrangement ensures correction of density at the time of correction by the control means, and supplies an image of appropriate density at all times.

The control method of a heat developing apparatus according to the present invention comprises;

a step of feeding a heat-processable photo-sensitive material, a step of forming a latent image by exposure on the heat-processable photo-sensitive material based on the image signal, and a step of heat-developing the heat-processable photo-sensitive material with the aforementioned latent image formed thereon.

The aforementioned control method is characterized by further comprising;

a step of loading the package incorporating the aforementioned heat-processable photo-sensitive material into the aforementioned heat developing apparatus, a step of determining if the density of the heat-processable photo-sensitive material in the aforementioned package is to be corrected or not, a step of exposing and forming a latent image on the aforementioned heat-processable photo-sensitive material in response to a predetermined signal for density measurement when the aforementioned density is to be corrected, a step of heat-developing the heat-processable photo-sensitive material containing the aforementioned latent image, a step of obtaining the information on the density of the image for measuring the density of the aforementioned developed heat-processable photo-sensitive material, and a step of correcting the aforementioned density so as to correct the difference from the desired density based the information on the density of the image for measuring the density.

According to this heat developing apparatus control method, the proper time for density correction is determined before it is performed. This arrangement ensures density correction to be performed at properly timed intervals, without density correction uniformly performed immediately before a package has been loaded into the heat developing apparatus. This arrangement properly eliminates the influence upon the development density by the changes in the sensitivity of the heat-processable photo-sensitive material and characteristic changes of the exposure means under the influence of temperature changes in the apparatus, and provides an image of appropriate density at all times.

The aforementioned density correction according to the heat developing apparatus control method is preferably performed in any one of the following cases;

when an image signal is received and there is a print request;

when the apparatus has received multiple image signals and is waiting for printing;

when a predetermined time has passed after loading of the aforementioned package;

when a predetermined time has passed after the apparatus got into the ready state; and when the temperature inside the apparatus has reached a predetermined temperature history.

It is preferred to include the step of determining if re-correction is to be performed or not after the aforementioned density correction. This re-correction is preferably performed in one of the following cases;

a predetermined time after the previous density correction, when a certain fluctuation of density occurs after the density of the heat-processable photo-sensitive material having been developed subsequent to the previous density correction is read, and this reading is compared with the reference density, and a predetermined time after the previous development.

DETAILED DESCRIPTION OF THE PREFERRED EMBODIMENT

Figure 1:
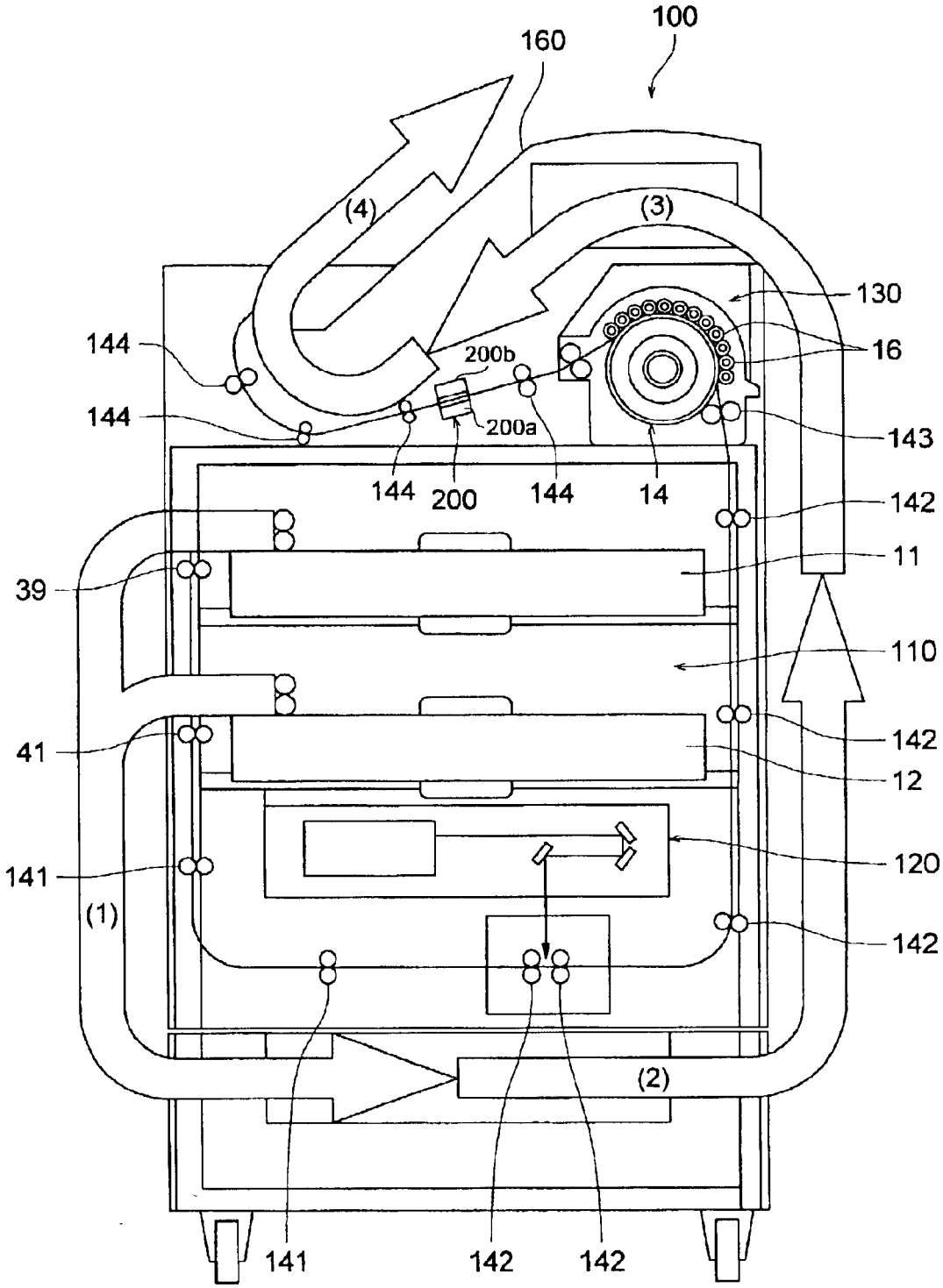
FIG. 1 is a front view representing the major portions of a heat developing apparatus as an embodiment according to the present invention.
Figure 2:
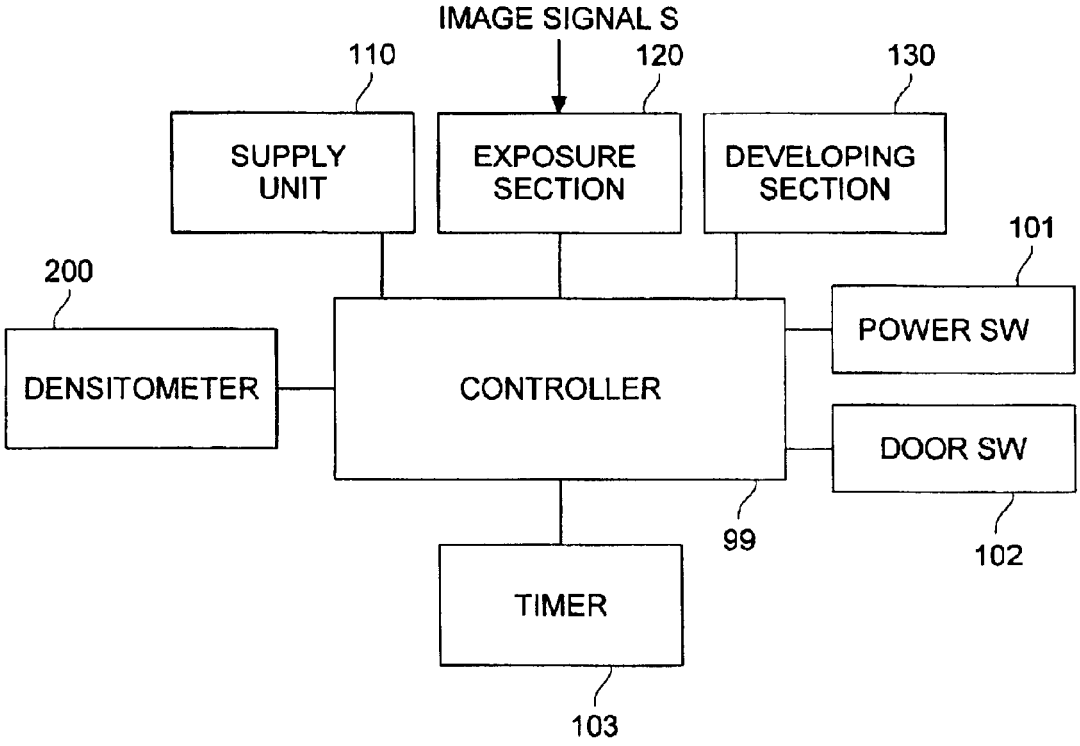
FIG. 2 is a block diagram representing the control system of the heat developing apparatus given in FIG. 1.
Figure 3:
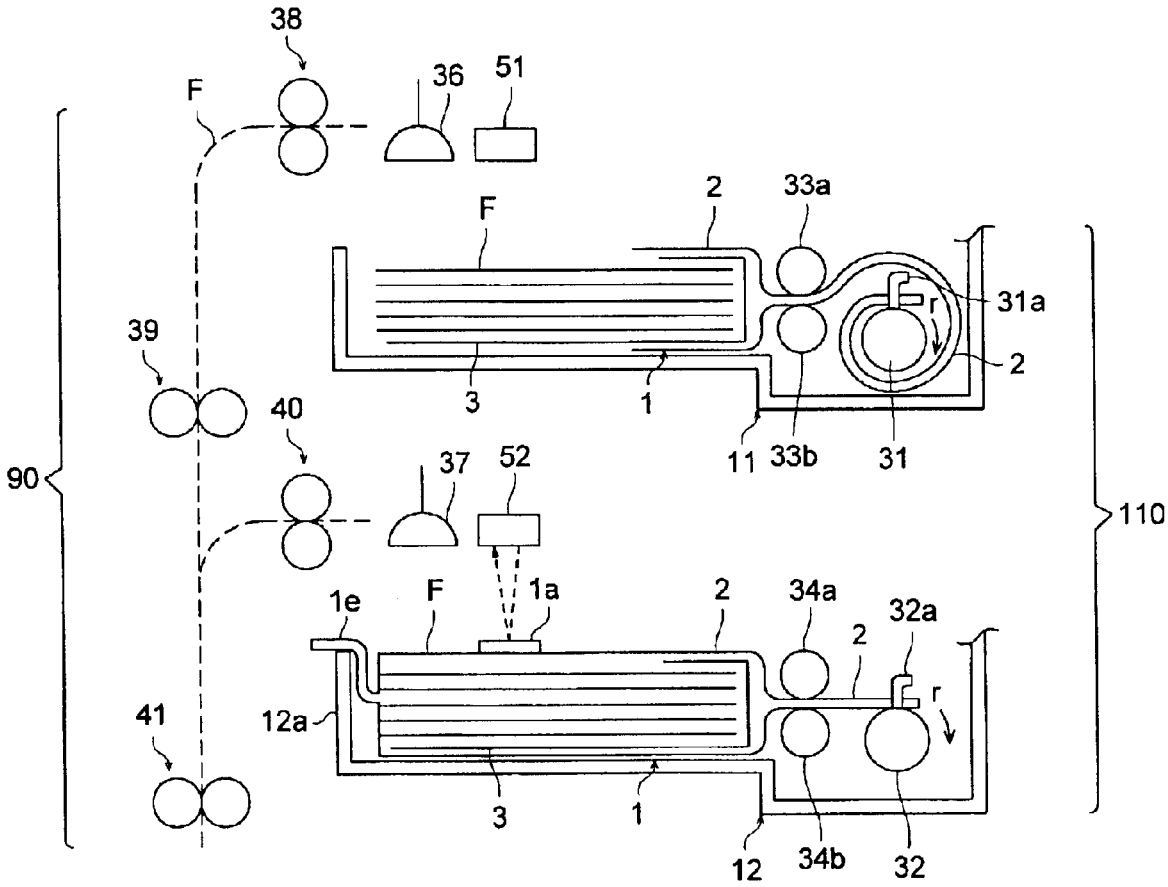
FIG. 3 is a front view representing the supply unit of a heat developing apparatus given in FIG. 1.
Figure 4:
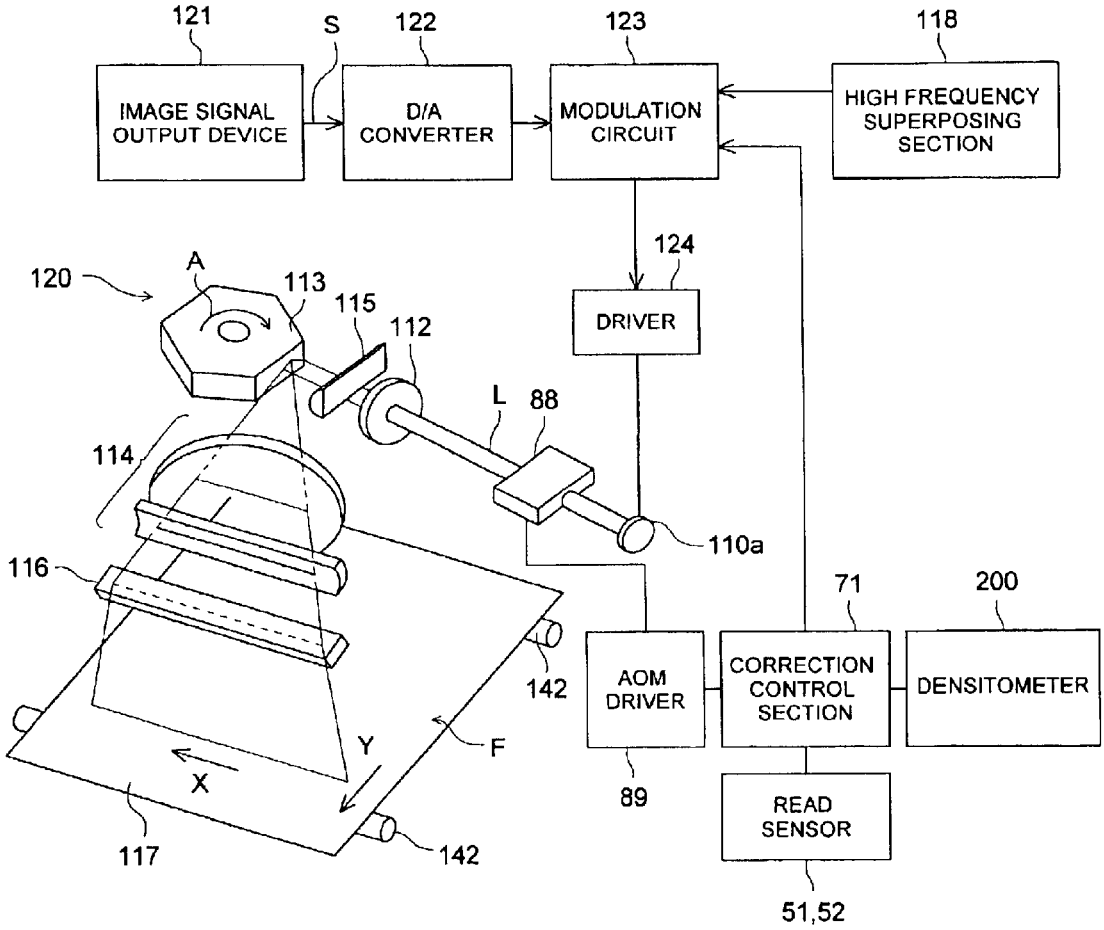
FIG. 4 is a schematic drawing representing the exposure unit of the heat developing apparatus given in FIG. 1.

The following describes the embodiments of the present invention with reference to drawings: FIG. 1 is a front view representing the major portions of a heat developing apparatus as an embodiment according to the present invention. FIG. 2 is a block diagram representing the control system of the heat developing apparatus given in FIG. 1. FIG. 3 is a front view representing the supply unit of the heat developing apparatus given in FIG. 1. FIG. 4 is a schematic drawing representing the exposure unit of the heat developing apparatus given in FIG. 1.

As shown in FIG. 1, the heat developing apparatus 100 comprises;

a supply unit 110 further comprising the first and second loading section 11 and 12 for loading the package composed of a predetermined number of the films as a sheet-like heat developed light sensitive materials, and a supply section 90 (FIG. 3) for feeding and supplying each sheet of film for exposure and development;

an exposure section 120 for exposing the film fed from the supply unit 110 and forming a latent image, a developing section 130 for heat-developing the film with latent image formed thereon, and a densitometer 200 for measuring the developed film and obtaining the information on density.

As shown in FIG. 2, the heat developing apparatus 100 has a controller 99 for controlling a supply unit 110, an exposition section 120 and a developing section 130. The controller 99 further controls a timer 103, a densitometer 200, an apparatus power switch 101, and a door switch 102 that turns off the power when the door is opened for loading into loading sections 11 and 12, and turns on the power when the door is closed. It receives control signals from the aforementioned portions for controlling the entire apparatus.

The following describes the supply unit 110 with reference to FIG. 3. As shown in FIG. 3, a film package 1 that can be loaded into the loading sections 11 and 12 of the supply unit 110 comprises a bag-like package member 2 composed of a soft material, multiple sheets of film F made of a heat-processable photo-sensitive material, and a pad sheet 3 for protecting multiple sheets of film by sandwiching them in-between. Multiple holes (not illustrated) are formed on one end of the package member 2. The surface of the package member 2 is provided with a bar code seal 1*a* recording the information on characteristics such as density of the packaged heat-processable photo-sensitive material. The information on the density of the heat-processable photo-sensitive material is used as density characteristics correction data. This bar code seal can be a magnetic tape, an optical recording medium, a photomagnetic recording medium or the like. The film package contains the film of various sizes such as 8"×10", 14"×17", 14"×14" or 11"×14". A film package comprising such films of different sizes can be loaded in the loading section 11 or 12.

The loading sections 11 and 12 in FIG. 3 comprises winding shafts 31 and 32 where anchoring devices 31*a* and 32*a* are passed through multiple holes of the film package 1, and the loading sections are turned in the direction "r" in FIG. 3 for pulling out so as to wind the package member 2 of the film package 1; and pairs of rollers 33*a*, 33*b*, 34*a* and

34*b* to nip the package member 2 of the film package 1. The winding shafts 31 and 32 are driven by the winding shaft drive mechanism (not illustrated) composed of a motor and belt mechanism. Turning in the direction r allows the package member 2 of the film package 1 to be pulled out by winding.

As shown in FIG. 3, the supply section 90 of the supply unit 110 comprises; holding members 36 and 37 that move in the horizontal and vertical directions in the drawing, while holding the films F by vacuum-sucking it in order to feed each sheet of multiple films F of the film package 1 out of the loading sections 11 and 12, a pair of rollers 38 and 39 for feeding the film F from the first loading section 11 by gripping it, a pair of rollers 40 for feeding the film F from the second loading section 12 by gripping it, and a pair of rollers 41 for feeding the film F from the first and second loading sections 11 and 12 to the lower position in the drawing by gripping it.

Read sensors 51 and 52 for reading the information of the barcode seal 1*a* of the package member 1 are arranged over the loading sections 11 and 12 respectively in FIG. 3. Light is emitted from the reading sensors 51 and 52 as shown by the broken line in FIG. 3, and the information on the density characteristics recorded on the barcode seal 1*a* can be read when this reflected light is read.

The following describes the exposure section 120 of the heat developing apparatus 100 with reference to FIG. 4: As shown in FIG. 4, the exposure section 120 uses the rotating polygon mirror to deflect the laser beam L having a wavelength from 780 to 860 nm (for example, 810 nm) based on the image signal S, and the surface of the film F is primary scanned. At the same time, it is sub-scanned by relative movement in the approximately horizontal direction that is approximately at a right angle to the primary scanning direction with respect to laser beam L, thereby forming a latent image on the film F.

The following describes more detailed configuration of the exposure section 120: When image signal S as a digital signal outputted from the image signal output device 121 is received in FIG. 4, it is converted into the analog signal by a D/A converter 122, and is put into a modulation circuit 123. Based on this analog signal, the modulation circuit 123 controls of the driver 124 of a laser light source 110 so that the modulated laser beam L is irradiated from the laser beam source 110*a*. Further, high frequency component is superimposed on the laser beam by the high frequency superposing section 118 through the modulation circuit 123 and driver 124, thereby preventing the interference fringe from being formed on the film.

An acousto-optic modulator 88 is arranged between the lens 112 of the exposure section 120 and laser beam source 110*a*. This acousto-optic modulator 88 is controlled and driven by an acousto-optic modulation (AOM) driver 89, based on the signal from the correction control section 71 for adjusting the level of modulation. The correction control section 71 determines the correction level of modulation in response to the density characteristic information of the film in the package read by the read sensors 51 and 52, and stores it in the memory. The acousto-optic modulation element 88 is controlled through the AOM driver 89 based on the stored correction level in such a way that the optimum modulation level (ratio of the amount of outgoing light with respect to the amount of incoming light) can be ensured at the time of exposure.

This arrangement provides exposure in conformity to the density characteristics for each of the films stored in multiple loading sections 11 and 12.

In the present embodiment, the film loaded in the loading sections 11 and 12 is exposed by the exposure section 120 according to the predetermined exposure pattern (test image for density measurement) on the tentative basis, and is developed by the developing section 130. After that, the density is measured by the densitometer 200. The information on this measured density is compared with a desired density, and the difference between the two is fed back to the controller 99 and correction control section 71 (FIG. 4), and control is made in the density correction method to ensure that the finished density of the film to be developed subsequently will be kept constant, wherein this density correction method is called calibration. In other words, after a new film package is loaded into the loading sections 11 and 12 or at the time of calibration to be performed as required, the correction control section 71 compares between each item of data on reference density and multiple pieces of density information within the range of a predetermined density obtained by using the densitometer 200 to measure the film with test image for density measurement formed thereon. The correction level for modulation is determined in conformity to the result of this comparison, and is stored in the memory. This correction level is obtained in multiple numbers in order to cover the range of the predetermined density. The correction control section 71 controls the acousto-optic modulator 88 through the AOM driver 89 based on the stored correction level in such a way that the optimum modulation level can be ensured at the time of exposure.

Then the laser beam L emitted from the laser beam source 110, with the amount of light appropriately adjusted by the acousto-optic modulation element 88, passes through the lens 112, and is converged only in the vertical direction by the cylindrical lens 115. Then it is launched as a linear image perpendicular to the drive shaft into the rotating polygon mirror 113 rotating in the direction marked by arrow A in FIG. 4. The rotating polygon mirror 113 reflects and deflects the laser beam L in the horizontal scanning direction. After passing through a lens unit 114 comprising a fθ lens and a cylindrical lens, the deflected laser beam L is reflected by a mirror 116 provided on the optical path extended in the horizontal scan direction, and the scanned surface 117 of the film F being fed in the direction marked by arrow Y by a feed apparatus 142 (subjected to sub-scanning) is repeatedly scanned in the horizontal direction marked by arrow X. This arrangement allows the laser L to scan the entire scanned surface 117 of the film F.

The cylindrical lens in the lens unit 114 is designed to converge the incoming laser beam on the scanned surface of film F only in the vertical direction. The distance from the lens unit 114 to the scanned surface of the film F is equal to the focal distance of the entire lens unit 114. In the exposure section 120, the cylindrical lens 115 and lens unit 114 are arranged in the aforementioned manner, and the laser beam L is once converged only in the vertical direction on the rotating polygon mirror 113. So even if surface tilting or shaft deviation occurs to the rotating polygon mirror 113, scanning lines of equal pitch are formed, without the scanning position of the of laser beam L being displaced in the vertical direction on the scanned surface of the film F. The rotating polygon mirror 113 is superior in scanning stability to a galvanometer mirror or other types of light deflectors. In the manner described above, a latent image is formed on the film F according to the image signal S.

As described above, the film of film F has a big characteristic variation for each production lot and each film package incorporating multiple sheets of film. The semiconductor laser as a light source does not have a range enough to modulate the light emitting intensity, therefore, even if the light emitting intensity is changed within this range, it may not be possible to respond to the characteristic variation. However, characteristic variation in exposure can be corrected by adjusting the light intensity (amount of light) through modulation based on the information on density characteristics of the film sent from the read sensors 51 and 52 using the acousto-optic modulation element 88 on the optical path.

Further, calibration is performed at a properly timed interval. The modulation level of the film with a test image for density measurement formed thereon is adjusted by the acousto-optic modulation element 88 based on the density information obtained by measuring with a densitometer 200. Thus, density correction is performed and an image of appropriate density is ensured, when there is any change in the film density subsequent to development, which may occur if the amount of laser beam L is changed due to the change of film sensitivity resulting from the fluctuation of temperature in the apparatus or due to the influence of the AOM driver 89 and high frequency superposing section 118.

The following describes the developing section 130 of the heat developing apparatus given in FIG. 1. As shown in FIG. 1, the development section 130 comprises a drum 14 that can be heated while holding the film F on its outer periphery, and multiple rolls 16 that hold the film sandwiched between itself and the drum 14. The drum 14 incorporates a heater (not illustrated), and provides heat development of the film F by keeping it at a temperature level above a predetermined minimum heat development temperature (for example, about 110° C.) for a predetermined heat developing time. Thus, the latent image formed on the film F by the aforementioned exposure section 120 is changed into a visible image.

The heater of drum 14 is controlled by the controller 99 of FIG. 2. The density can be adjusted by changing the development temperature through change of the heater temperature. The heater is turned on or off by the power switch 101 and door switch 102.

The heat developed film F can be separated from the drum 14, and fed by the feed apparatus 144, and the film density can be measured by the densitometer 200. The densitometer 200 comprises a light emitting section 200*a* and light receiving section 200*b*. When the developed film passes through the light emitting section 200*a* and light receiving section 200*b*, the light emitted from the light emitting section 200*a* is received by the light receiving section 200*b* through the film. And the density is measured according to the attenuated amount of the received light.

In the present embodiment, the developing section 130 together with the exposure section 120 is incorporated in the heat developing apparatus 100. It can be independent of the exposure section 120. In this case, there is preferred to be a feed section that allows the film F to be fed from the exposure section 120 to the developing section 130. Further, the drum 14 is preferably covered with a heat insulating material since the temperature of the drum 14 can be easily controlled.

Figure 5:
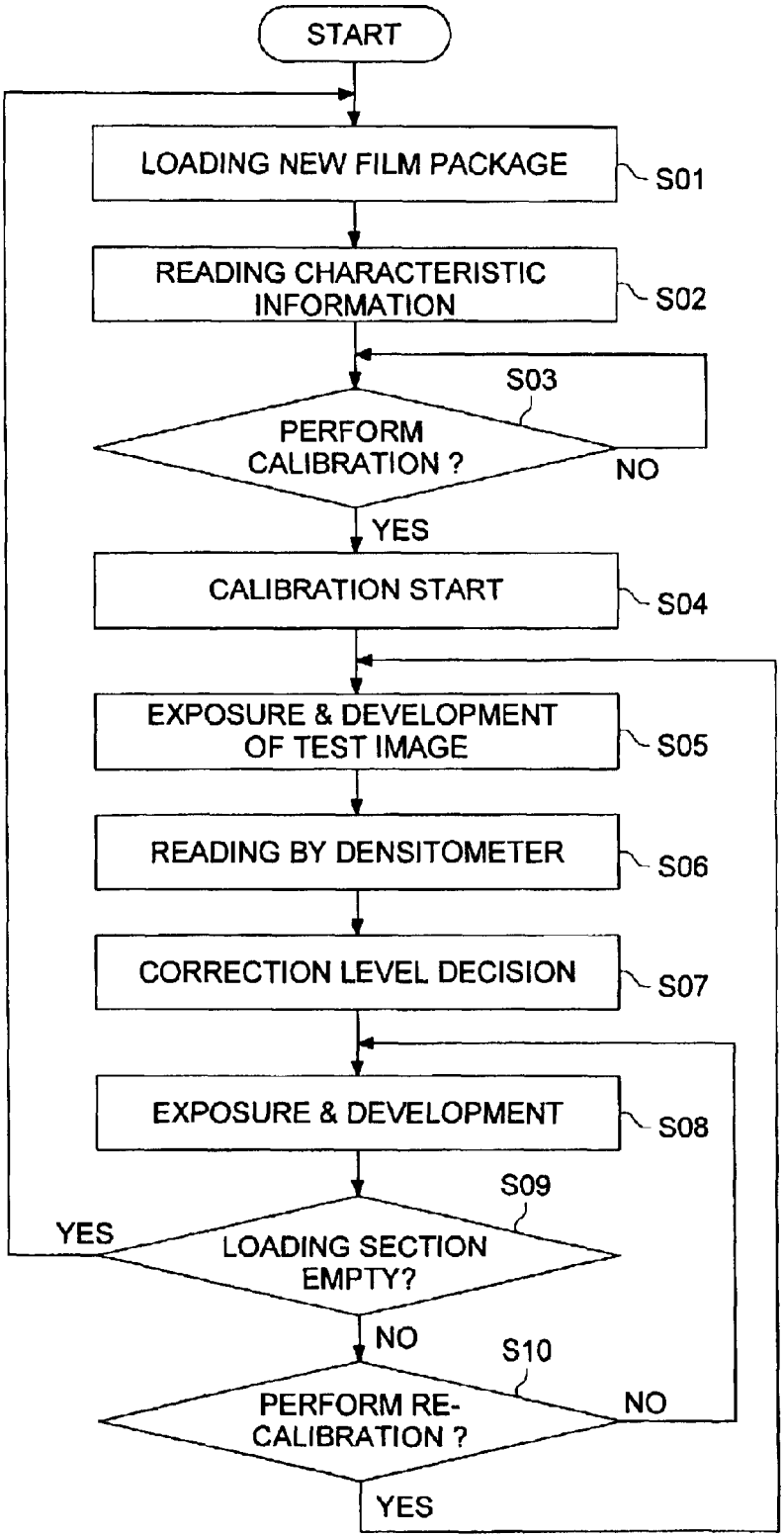
FIG. 5 is a schematic drawing representing the step of calibration in heat developing apparatus given in FIG. 1.

The following describes the operation of the heat developing apparatus 100 according to the Flow Chart in FIG. 5 with occasional reference to FIGS. 1 to 4.

First, the loading sections of 11 and 12 are pulled out by releasing the apparatus door, and a film package is mounted on the loading sections 11 and 12 (S01). In this case, multiple holes of the film package 1 are fixed to the anchoring section 31*a* (in the state of film package 1 in the loading section 12 in FIG. 3). The same operation is performed on the loading section 12.

Next, after the other end of the film package 1 slightly protruding from the loading section 12 to its side 12*a* has been cut off, the loading sections 11 and 12 are pushed into the apparatus 100. Under this condition, the read sensors 51 and 52 read respective data on density characteristics from the barcode seal 1*a* on the surface of each film package 1 loaded in each of the loading sections 11 and 12 (S02). The correction level determined in response to the density characteristics for each film package 1 loaded in each of the loading sections 11 and 12 is stored in the correction section 71 given in FIG. 4.

The controller 99 given in FIG. 2 determines if the calibration for density correction by forming a test image for density measurement on the film F on the top of a new film package 1 loaded in the first loading section 11 should be performed or not (S03). In this embodiment, calibration is not performed immediately after the film package 1 is loaded in the loading sections 11 and 12. It is performed when the exposure section 120 has received the image signal from the image signal output device 121 and a print request has been made. Calibration is started upon receipt of this print request (S04).

Namely, the winding shaft 31 of the loading section 11 is turned in the rotary direction r in FIG. 3 by operating the wind shaft drive mechanism (not illustrated). The package 2 of the film package 1 fixed to the anchoring section 31*a* of the winding shaft 31 is wound around it, and the package 2 is pulled halfway from the film package 1, without being pulled out completely. Then the holding member 36 is moved by a traveling mechanism (not illustrated) downward in FIG. 3. When it has brought in contact with the film F on the top of the film package 1 in the loading section 11, the film F is held in the sucked state by a vacuum suction apparatus (not illustrated) linked to the holding member 36. While the holding member 36 holds the film F, it is moved close to a pair of rollers 38, by the vertical and leftward traveling of the traveling mechanism so that the film F is fed into the pair of rollers 38. Then film F is fed downward by the pair of rollers 39 and 41. The loading sections 11 and 12 have film size detecting means, which detect the size of the film F taken out. The reading is sent as size information to the transporting apparatus comprising pairs of rollers 141, 142, 143, etc. and development section 130. The development section 130 controls the heat according to the film size.

As shown in FIG. 1, when the film F fed by the pair of rollers 141 in the direction of (1) has reached the exposure section 120, the film F is scanned and exposed by laser beam based on the test image signal for density measurement stored in the memory of the controller 99, while being sub-scanned by the pair of roller 142 at the exposure section 120. In this case, the acousto-optic modulator 88 is controlled by the AOM driver 89 in such a way that the optimum modulation level determined in response to the density characteristics of the film in the package read in Step S02 and stored in the correction control section 71 of the exposure section 120 can be achieved. This arrangement ensures exposure to be carried out in conformity to the density characteristics of the film.

The test image for density measurement includes the image where a predetermined amount of light in multiple steps of 5 to 100 steps (for example, 20 steps) is exposed by changing the position in the feed direction sequentially, and the one where a predetermined amount of light in multiple steps of 5 to 100 steps (for example, 20 steps) is exposed by changing the position in the form of a matrix sequentially. However, a test image of another pattern can also be used.

As described above, the film F where a latent image of the test image for density measurement is formed by the scanning of laser beam is fed in the direction (2) in FIG. 1 by the pair of roller 142, and is then fed to the development section 130 by the pair of rollers 143. The film F passes between the drum 14 and multiple rollers 16 to be heated around the drum 14 through the rotation of the drum 14. While being heated in this manner, the film F is fed in the direction (3), whereby it is heat-developed and the latent image of the test image for density measurement is made visible (S05).

Then the film F with the visualized test image for density measurement is feed by the pair of rollers 144. The density of the test image for density measurement is measured by densitometer 200. The film F is further fed in the direction (4) by the pair of roller 144, and is discharged into the ejection tray 160 outside the apparatus 100.

Multiple pieces of density information read by the densitometer 200 from the test image for density measurement are compared with the stored reference density data by the correction control section 71 of the exposure section 120, which stores multiple correction levels determined in such a way that the amount of modulation by the acousto-optic modulator 88 will become the optimum within the range of a predetermined density in response to the result of this comparison (S07). This step allows laser beam to be controlled to have the appropriate amount of modulation by passing through the acousto-optic modulator 88 in the subsequent steps of exposure, with the result that development is performed at an appropriate density, and calibration is completed.

In the same manner as above, film F is fed from the film package 1 of the loading section 11, and is exposed normally at the exposure section 120 by the laser beam of the optimum modulation level based on the image signal S received from the image signal output device 121. The film F is heat developed by the development section 130 to get an appropriate visible image (S08). These exposure and development are carried out until there is no more film left in the package 1 of the loading section 11. (S09). During this time, control is made to determine if re-calibration is necessary or not (S10).

In the present embodiment, this re-calibration is carried out a predetermined time after calibration is performed in Step S04. Upon termination of calibration in Step 04, the controller 99 actuates the timer 103 on which a predetermined time is preset, and calibration in steps S05 to S07 is carried out again if a predetermined time has passed before there is no more film left in the package 1 (S10).

As described above, in the heat developing apparatus according to the present embodiment, calibration for density correction is not performed immediately after the loading section is loaded with a new film package. Calibration is carried out only when the apparatus has received a print request. Therefore, the calibration is performed and the density correction is conducted at the temperature in the apparatus immediately before the film is exposed and developed. This arrangement eliminates the adverse effect of the changing development density due to changes of film sensitivity resulting from changes in temperature in the apparatus or changes of characteristics in various sections of the exposure section 120, whereby an image of appropriate density can be ensured at all times. Especially the AOM driver 89 of the exposure section 120 and high frequency superposing section 118 is susceptible to the changes in characteristics due to temperature fluctuation. Such changes in characteristics can be effectively removed.

After the lapse of a predetermined time, calibration is performed again. So density correction is performed at properly timed intervals in regard to the changes of film sensitivity under the influence of changes of temperature in the apparatus due to the passage of a predetermined time, or changes of characteristics in the AOM driver 89 of the exposure section 120 and high frequency superposing section 118. Thus, an image of appropriate density at all times.

The calibration in Step S03 in FIG. 5 can be performed in any one of the following cases where (1) the exposure section 120 has received an image signal from the image signal output device 121, and a print request has been made; (2) the exposure section 120 has received multiple image signals; (3) a predetermined time has passed after the film package 1 is loaded in the loading sections 11 and 12; (4) a predetermined time has passed after the power switch 101 or door switch 102 in FIG. 2 is turned on and the apparatus gets ready for printing; and (5) the temperature of the drum 14 has reached a predetermined temperature history, for example, the temperature reached about 120° C. after the temperature in the apparatus is reduced by opening and closing of the door, and the electric power of the developing section 130 is again turned on, in case of opening the door to load the film package into the loading section and closing it thereafter. This arrangement allows calibration to be performed at properly timed intervals, whereby an image of appropriate density can be obtained at all times.

The predetermined time mentioned in the aforementioned (3) and (4) refer to the predetermined time is preset on the timer, and can be measured by the timer 103 operated by the controller 99. This predetermined time is preset, for example, based on temperature characteristics of the AOM driver of the exposure section 120 and temperature characteristics of the high frequency superposing section. This makes it possible to perform calibration after the lapse of the predetermined time, when a steady state has been reached where there is almost no change in the temperature characteristics of the AOM driver or high frequency superposing section. Accordingly, stable maintenance of the validity of density correction due to calibration is ensured, and an image of appropriate density can be obtained at all times.

The aforementioned heat developing apparatus 100 comprises multiple loading sections. For example, when a new package is loaded in the first loading section 11, calibration is not performed immediately thereafter. The film is supplied from the second loading section 12. If this loading section 12 runs out of film, film can be supplied from the loading section 11. However, if the film of the first loading section 11 is calibrated or density in the aforementioned cases (1) to (5), appropriate density can be corrected at properly timed intervals.

Re-calibration in Step S10 shown in FIG. 5 may be performed a predetermined time after the previous development. For example, when the film in the same package is to be used before and after a long-term suspension of operation on holidays or vacations, this arrangement allows density correction to be performed at properly timed intervals, in response to changes in sensitivity of the film and characteristic change of the AOM driver 89 of the exposure section 120 and high frequency superposing section 118 due to the influence of the changes in the temperature inside the apparatus resulting from the passage of a predetermined time, thereby supplying an image of appropriate density at all times.

Figure 6:
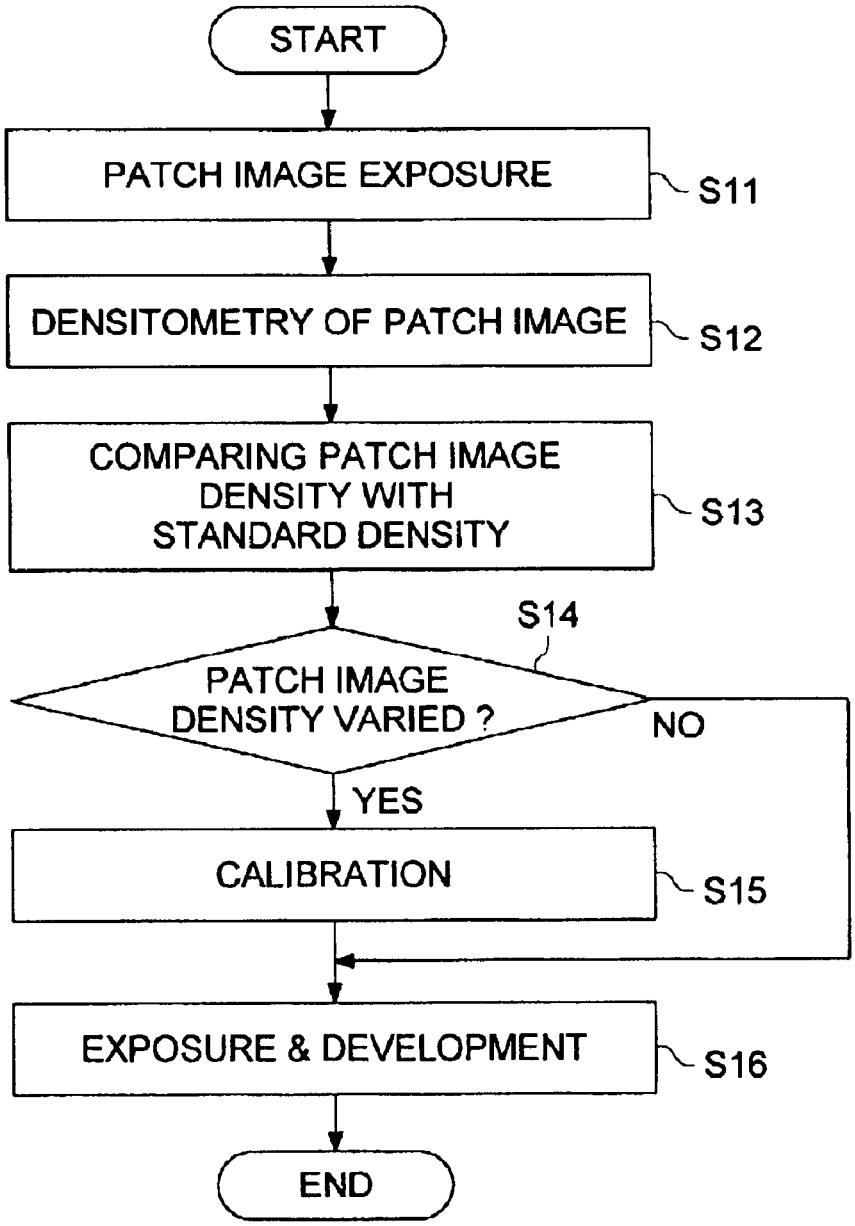
FIG. 6 is a flow chart representing the step of re-calibration in heat developing apparatus given in FIG. 5.

The following describes another method for re-calibration in Step S10 of FIG. 5 with reference to FIG. 6. The example of FIG. 6 refers to the use of a density image (patch image) for density management formed in a small corner of the film under a certain condition at the time of exposure and development of a normal image is exposed and developed.

In other words, a patch image is formed in a small corner of the film (S11) when a normal image is formed in Step S08 of FIG. 5. The density of this patch image is measured by the densitometer 200 (S12), and the density of the measured patch image is compared with the reference density (standard density) (S13). If the variation of the density (difference in density of the two) exceeds a certain level (S14), calibration is performed, similarly to the case of FIG. 5 (S15). If it is below that level, a normal image is formed (S16).

The aforementioned control is carried out by the controller 99 of FIG. 2. The reference density can be the value obtained in the previous calibration, or a value set in advance. It can be stored in the memory of the controller 99 and correction control section 71.

Despite changes in the development density that may result from the changes in sensitivity of the film and characteristic change of the AOM driver 89 of the exposure section 10 and high frequency superposing section 118 due to the influence of the changes in the temperature inside the apparatus, the method given in FIG. 6 allows the change in density to be checked. If the change in density is over a predetermined level, calibration is performed again to correct the density, whereby an image of appropriate density is provided at all times.

Figure 7:
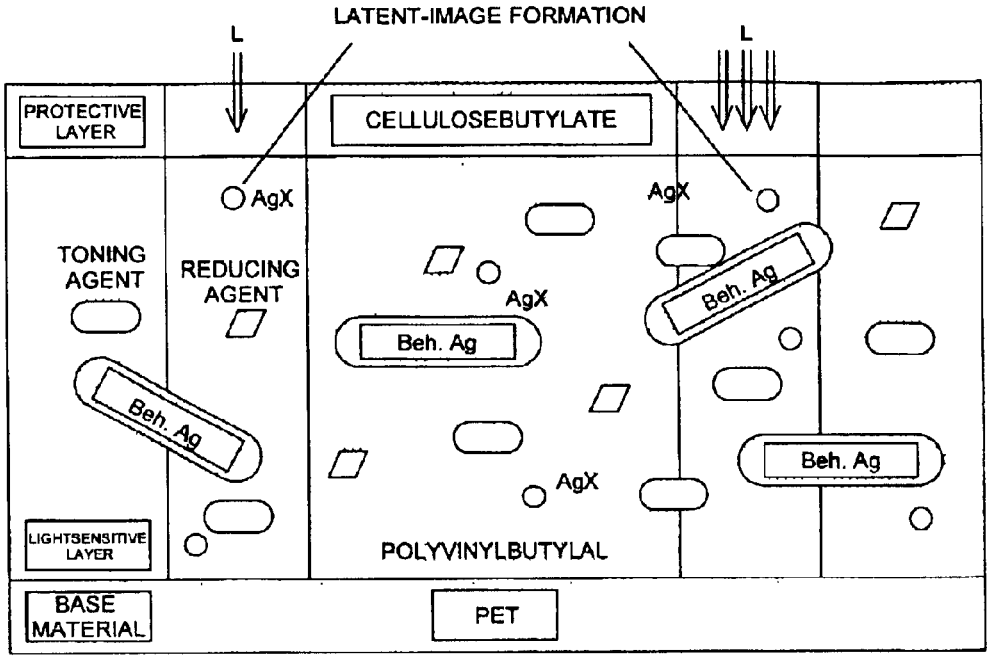
FIG. 7 is a cross sectional view of the film F, giving a schematic representation of chemical reaction in the film F at the time of exposition by a heat developing apparatus of FIG. 1.
Figure 8:
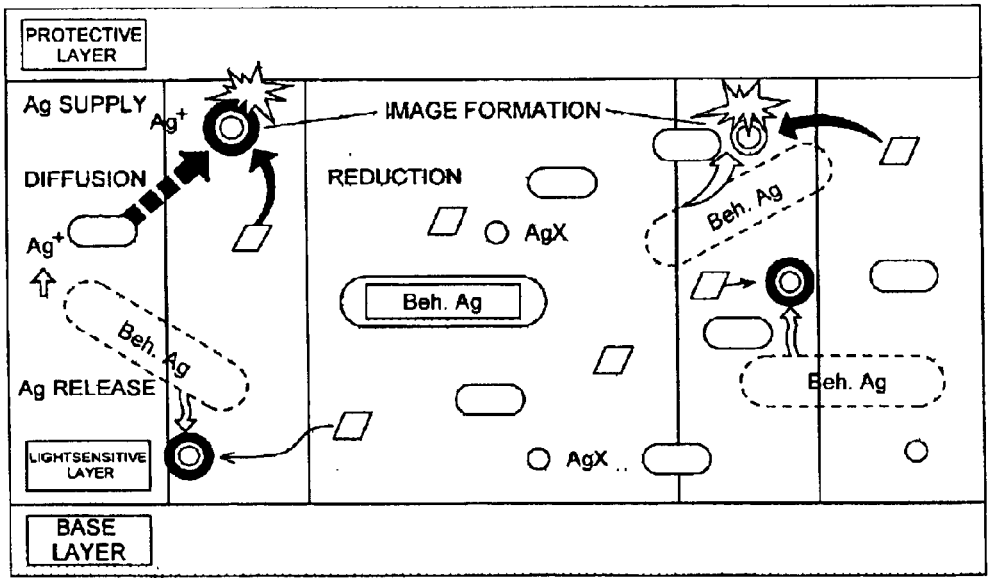
FIG. 8 is a cross sectional view of the film F, similarly to FIG. 7, giving a schematic representation of chemical reaction in the film F at the time of heating by a heat developing apparatus of FIG. 1.

FIGS. 7 and 8 will be used to describe the film F as a heat-processable photo-sensitive material. FIG. 7 is a cross sectional view of the film F, giving a schematic representation of chemical reaction in the film F at the time of exposition. FIG. 8 is a cross sectional view of the film F, similarly to FIG. 7, giving a schematic representation of chemical reaction in the film F at the time of heating.

Film F is configured in such a way that a light sensitive layer comprising heat resistant binder as a major constituent is formed on the base material (substrate) consisting of PET, and a protective layer comprising heat resistant binder as a major constituent is formed further on the light sensitive layer. The light sensitive layer contains silver halide particles (AgX), silver behenate as a type of organic acid silver (Beh. Ag), reducing agent and toning agent blended with one another. A back surface layer (not illustrated) comprising heat resistant binder as a major constituent is formed on the back surface of the base material.

When laser beam L is irradiated to film F from the exposure section 120 in the aforementioned process of exposure, silver halide particles are exposed to light in the area where laser beam L is irradiated, as shown in FIG. 7, with the result that a latent image is formed. As described above, when film F is heated by the drum 14 of the developing section 130 to exceed the minimum heat developing temperature, silver ion ($Ag^+$) is released from silver behenate, as shown in FIG. 8, and behenic acid released from the silver ion forms a complex with the toning agent. After that, silver ion diffuses and the reducing agent is activated using the sensitized silver halide particles as nuclei. Then a silver image is assumed to be formed by chemical reaction. As described above, film F contains light sensitive silver halide particles, organic silver salt and silver ion reducing agent. Substantially heat development is not performed at a temperature of 40° C. or less. Heat development is carried out at the minimum development temperature of 80° C. or more (for example, about 110° C.).

The above description is based on the embodiments of the present invention. However, it is to be understood that the present invention is not limited only to the aforementioned embodiments. A great number of variations are possible within the range of the technological concept of the present invention. For example, in the aforementioned embodiments, calibration for density correction is carried out by adjusting the intensity of laser beam (amount of light). It can also be performed by controlling the heater temperature of the drum 14 of the developing section 130 and adjusting the developing temperature. Alternatively, only one loading section for loading a film package may be used, or three or more may be used, as a matter of course.

The heat development apparatus and heat development apparatus control method eliminate the adverse effect of changes of temperature in the apparatus or the like upon development density, whereby an image of appropriate density is provided at all times.

What is claimed is:

1. A heat developing apparatus for developing a heat-processable photo-sensitive material comprising:

a supply unit having a loading section for loading the heat-processable photo-sensitive material;

an exposure unit for forming a latent image on the heat-processable photo-sensitive material fed by the supply unit based on an image signal or on a predetermined signal for density measurement;

a developing unit for heat development of heat-processable photo-sensitive material containing the latent image;

a device for gaining density information of the heat-processable photo-sensitive material developed by the developing unit; and a controller for conducting a correction for a density of the heat-processable photo-sensitive material based on a desired density and the density information, by controlling at least one of the exposure unit and the developing unit;

wherein, (i) if a print request has not been received at the time when a new package incorporating the heat-processable photo-sensitive material is loaded on the loading section, the controller conducts the correction according to the density information gained by forming and developing a latent image based on the predetermined signal for density measurement after the print request is received; and (ii) if a print request has been already received at the time when the new package is loaded on the loading section, the controller conducts the correction according to the density information gained by forming and developing a latent image based on the predetermined signal for density measurement when the new package is loaded on the loading section.

2. The heat developing apparatus of claim 1, wherein the controller conducts the correction when a predetermined time elapsed since a new package incorporating the heat-processable photo-sensitive material has been loaded on the loading section.

3. The heat developing apparatus of claim 1, wherein the controller conducts the correction when a predetermined time elapsed since the heat developing apparatus has become ready state, after a new package incorporating the heat-processable photo-sensitive material has been loaded on the loading section.

4. The heat developing apparatus of claim 1, wherein the supply unit comprises a plurality of loading sections for loading the heat-processable photo-sensitive material.

5. The developing apparatus according to claim 1, wherein the controller conducts the correction by changing at least one of a light amount in the exposure unit and a development temperature in the developing unit.

6. The developing apparatus according to claim 1, wherein when the loading section is loaded with a package incorporating the heat-processable photo-sensitive material and the indicating characteristics information of the heat-processable photo-sensitive material, the characteristic information is read with a reader provided at the loading section, and the controller set at least one of a light amount in the exposure unit and a development temperature in the developing unit according to the characteristic information read by the reader.

7. A heat developing apparatus for developing a heat-processable photo-sensitive material comprising:

a supply unit having a loading section for loading the heat-processable photo-sensitive material;

an exposure unit for forming a latent image on the heat-processable photo-sensitive material fed by the supply unit based on an image signal or on a predetermined signal for density measurement;

a developing unit for heat development of heat-processable photo-sensitive material containing the latent image;

a device for gaining density information of the heat-processable photo-sensitive material developed by the developing unit; and a controller for conducting a correction for a density of the heat-processable photo-sensitive material based on a desired density and the density information, by controlling at least one of the exposure unit and the developing unit;

wherein, the controller conducts the correction according to the density information gained by forming and developing a latent image based on the predetermined signal for density measurement when a predetermined time elapsed since a new package incorporating the heat-processable photo-sensitive material has been loaded on the loading section, wherein exposure unit comprises at least one of the acousto-optic modulation driver and high frequency superposing device, and the predetermined time is set based on at least one of the temperature characteristics of the acousto-optic modulation driver and the temperature characteristics of the high frequency superposing device.

8. A heat developing apparatus for developing a heat-processable photo-sensitive material comprising:

a supply unit having a loading section for loading the heat-processable photo-sensitive material;

an exposure unit for forming a latent image on the heat-processable photo-sensitive material fed by the supply unit based on an image signal or on a predetermined signal for density measurement;

a developing unit for heat development of heat-processable photo-sensitive material containing the latent image;

a device for gaining density information of the heat-processable photo-sensitive material developed by the developing unit; and a controller for conducting a correction for a density of the heat-processable photo-sensitive material based on a desired density and the density information, by controlling at least one of the exposure unit and the developing unit;

wherein, the controller conducts the correction according to the density information gained by forming and developing a latent image based on the predetermined signal for density measurement when the developing unit has reached a predetermined temperature history after a new package incorporating the heat-processable photo-sensitive material has been loaded on the loading section.

9. A control method of a heat developing apparatus, which is structured to transport a heat-processable photo-sensitive material, to form a latent image in the heat-processable photo-sensitive material by exposing based on an image signal, and to develop the heat-processable photo-sensitive material with the latent image formed therein, the control method comprising, loading a package incorporating the heat-processable photo-sensitive material into the heat developing apparatus;

determining if a correction is to be conducted or not for a density of the heat-processable photo-sensitive material in the package;

forming a latent image on the heat-processable photo-sensitive material by exposing according to a predetermined signal for density measurement when the correction is to be conducted;

developing the heat-processable photo-sensitive material carrying the latent image to form an image for density measurement;

obtaining density information of the image for density measurement; and conducting the correction for the density of the heat-processable photo-sensitive material based on a desired density and the density information, wherein in the determining step, the correction is determined to be conducted, (i) when a print request is received, if a print request has not been received at the time when a new package incorporating the heat-processable photo-sensitive material is loaded, and (ii) when the new package is loaded, if a print request has been already received at the time when the new package is loaded on the loading section.

10. A control method of a heat developing apparatus, which is structured to transport a heat-processable photo-sensitive material, to form a latent image in the heat-processable photo-sensitive material by exposing based on an image signal, and to develop the heat-processable photo-sensitive material with the latent image formed therein, the control method comprising, loading a package incorporating the heat-processable photo-sensitive material into the heat developing apparatus;

determining if a correction is to be conducted or not for a density of the heat-processable photo-sensitive material in the package;

forming a latent image on the heat-processable photo-sensitive material by exposing according to a predetermined signal for density measurement when the correction is to be conducted;

developing the heat-processable photo-sensitive material carrying the latent image to form an image for density measurement;

obtaining density information of the image for density measurement; and conducting the correction for the density of the heat-processable photo-sensitive material based on a desired density and the density information, wherein in the determining step, the correction is determined to be conducted, when a predetermined time elapsed since the heat developing apparatus has become ready state, the predetermined time being set based on at least one of the temperature characteristics of an acousto-optic modulation driver and the temperature characteristics of a high frequency superposing device, and the acousto-optic modulation driver and the high frequency superposing device being provided in the heat developing apparatus.

11. A control method of a heat developing apparatus, which is structured to transport a heat-processable photo-sensitive material, to form a latent image in the heat-processable photo-sensitive material by exposing based on an image signal, and to develop the heat-processable photo-sensitive material with the latent image formed therein, the control method comprising, loading a package incorporating the heat-processable photo-sensitive material into the heat developing apparatus;

determining if a correction is to be conducted or not for a density of the heat-processable photo-sensitive material in the package;

forming a latent image on the heat-processable photo-sensitive material by exposing according to a predetermined signal for density measurement when the correction is to be conducted;

developing the heat-processable photo-sensitive material carrying the latent image to form an image for density measurement;

obtaining density information of the image for density measurement; and conducting the correction for the density of the heat-processable photo-sensitive material based on a desired density and the density information, wherein in the determining step, the correction is determined to be conducted, when temperature inside the heat developing apparatus has reached a predetermined temperature history.

* * * * *